US010180038B2

(12) United States Patent
Reinhardt

(10) Patent No.: US 10,180,038 B2
(45) Date of Patent: Jan. 15, 2019

(54) FORCE TRANSFERRING MEMBER FOR USE IN A TOOL

(71) Applicant: Weatherford Technology Holdings, LLC, Houston, TX (US)

(72) Inventor: Paul Andrew Reinhardt, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 149 days.

(21) Appl. No.: 15/147,302

(22) Filed: May 5, 2016

(65) Prior Publication Data

US 2016/0326831 A1 Nov. 10, 2016

Related U.S. Application Data

(60) Provisional application No. 62/157,691, filed on May 6, 2015.

(51) Int. Cl.

| | |
|---|---|
| ***E21B 33/128*** | (2006.01) |
| ***E21B 33/129*** | (2006.01) |
| ***E21B 23/00*** | (2006.01) |

(52) U.S. Cl.

CPC ..... *E21B 33/1285* (2013.01); *E21B 23/00* (2013.01); *E21B 33/128* (2013.01); *E21B 33/1293* (2013.01)

(58) Field of Classification Search

CPC ..... E21B 33/1285; E21B 33/128; E21B 33/1293; E21B 23/00

See application file for complete search history.

(56) References Cited

U.S. PATENT DOCUMENTS

| | | | |
|---|---|---|---|
| 2,125,665 | A | 8/1938 | Bettis |
| 2,652,894 | A | 9/1953 | Brown et al. |
| 3,147,016 | A | 9/1964 | Traufler |
| 3,215,208 | A | 11/1965 | Tamplen |
| 3,227,462 | A | 1/1966 | Tamplen |
| 3,278,192 | A | 10/1966 | Tamplen |
| 3,374,838 | A | 3/1968 | Current |
| 3,631,926 | A | 1/1972 | Young |
| 3,784,214 | A | 1/1974 | Tamplen |
| 4,482,086 | A | 11/1984 | Wagner et al. |
| 4,588,029 | A | 5/1986 | Blizzard |
| 4,752,444 | A | 6/1988 | Bowen et al. |
| 4,757,860 | A | 7/1988 | Reimert |
| 4,809,989 | A | 3/1989 | Kernal |

(Continued)

FOREIGN PATENT DOCUMENTS

| | | | |
|---|---|---|---|
| RU | 1367586 | C | 11/1996 |
| WO | 02097234 | A1 | 12/2002 |
| WO | 2008014095 | A1 | 1/2008 |

OTHER PUBLICATIONS

PCT International Search Report and Written Opinion dated Jul. 28, 2016, for International Patent Application No. PCT/2016/031103.

*Primary Examiner* — D. Andrews
*Assistant Examiner* — Yanick A Akaragwe
(74) *Attorney, Agent, or Firm* — Patterson + Sheridan, LLP

(57) ABSTRACT

A tool for use in a wellbore comprising a seal assembly, a collet member, and a cone member. The seal assembly is coupled to the collet member and in engagement with the cone member. A force transferring member is movable from a first state that prevents relative movement between the seal assembly and the cone member, to a second state where the seal assembly is movable relative to the cone member.

18 Claims, 11 Drawing Sheets

(56) References Cited

U.S. PATENT DOCUMENTS

| | | | |
|---|---|---|---|
| 4,842,061 | A | 6/1989 | Nobileau |
| 5,052,483 | A | 10/1991 | Hudson |
| 5,076,356 | A | 12/1991 | Reimert |
| 5,311,938 | A | 5/1994 | Hendrickson et al. |
| 5,333,692 | A | 8/1994 | Baugh et al. |
| 5,355,961 | A | 10/1994 | Gariepy et al. |
| 5,433,269 | A | 7/1995 | Hendrickson |
| 5,462,121 | A | 10/1995 | Schmuck et al. |
| 5,467,822 | A | 11/1995 | Zwart |
| 5,511,620 | A | 4/1996 | Baugh et al. |
| 5,603,511 | A | 2/1997 | Keyser, Jr. et al. |
| 5,685,369 | A | 11/1997 | Ellis et al. |
| 5,857,520 | A | 1/1999 | Mullen et al. |
| 6,123,148 | A | 9/2000 | Oneal |
| 6,142,227 | A | 11/2000 | Hiorth et al. |
| 6,409,175 | B1 | 6/2002 | Evans et al. |
| 6,425,444 | B1 | 7/2002 | Metcalfe et al. |
| 6,446,717 | B1 | 9/2002 | White et al. |
| 6,666,276 | B1 | 12/2003 | Yokley et al. |
| 6,691,789 | B2 | 2/2004 | Jackson et al. |
| 6,705,615 | B2 | 3/2004 | Milberger et al. |
| 6,763,893 | B2 | 7/2004 | Braddick |
| 6,769,491 | B2 | 8/2004 | Zimmerman et al. |
| 6,772,844 | B2 | 8/2004 | Lloyd et al. |
| 6,789,622 | B1 | 9/2004 | Ducasse et al. |
| 6,814,143 | B2 | 11/2004 | Braddick |
| 6,902,008 | B2 | 6/2005 | Hirth et al. |
| 6,962,206 | B2 | 11/2005 | Hirth et al. |
| 7,036,581 | B2 | 5/2006 | Trahan |
| 7,165,622 | B2 | 1/2007 | Hirth et al. |
| 7,172,029 | B2 | 2/2007 | Hirth et al. |
| 7,213,814 | B2 | 5/2007 | Hurlbert et al. |
| 7,225,880 | B2 | 6/2007 | Braddick |
| 7,234,533 | B2 | 6/2007 | Gambier |
| 7,252,142 | B2 | 8/2007 | Brezinski et al. |
| 7,322,422 | B2 | 1/2008 | Patel |
| 7,360,592 | B2 | 4/2008 | McMahan |
| 7,367,404 | B2 | 5/2008 | Simpson et al. |
| 7,370,708 | B2 | 5/2008 | Simpson et al. |
| 7,380,592 | B2 | 6/2008 | Atkins et al. |
| 7,387,170 | B2 | 6/2008 | Doane et al. |
| 7,407,165 | B1 | 8/2008 | Chisnell |
| 7,441,606 | B2 | 10/2008 | Maguire |
| 7,469,750 | B2 | 12/2008 | Carr |
| 7,493,945 | B2 | 2/2009 | Doane et al. |
| 7,665,532 | B2 | 2/2010 | Cook et al. |
| 7,703,542 | B2 | 4/2010 | O'Connor et al. |
| 7,740,248 | B2 | 6/2010 | Keene et al. |
| 7,748,467 | B2 | 7/2010 | Doane |
| 7,766,088 | B2 | 8/2010 | Saucier et al. |
| 7,775,290 | B2 | 8/2010 | Brisco et al. |
| 7,779,927 | B2 | 8/2010 | Turley et al. |
| 7,784,797 | B2 | 8/2010 | Baugh et al. |
| 7,921,921 | B2 | 4/2011 | Bishop et al. |
| 8,066,065 | B2 | 11/2011 | Buckner |
| 8,109,340 | B2 | 2/2012 | Doane et al. |
| 8,459,347 | B2 | 6/2013 | Stout |
| 8,997,882 | B2 | 4/2015 | Turley et al. |
| 2002/0088616 | A1 | 7/2002 | Swor et al. |
| 2002/0148612 | A1 | 10/2002 | Cook et al. |
| 2004/0060706 | A1 | 4/2004 | Stephenson |
| 2004/0123983 | A1 | 7/2004 | Cook et al. |
| 2005/0172472 | A1 | 8/2005 | Verger et al. |
| 2005/0173110 | A1 | 8/2005 | Trahan |
| 2006/0186602 | A1 | 8/2006 | Martin et al. |
| 2006/0272827 | A1 | 12/2006 | Adam et al. |
| 2007/0151725 | A1 | 7/2007 | Cook et al. |
| 2009/0205843 | A1 | 8/2009 | Gandikota et al. |
| 2010/0089591 | A1 | 4/2010 | Thomson et al. |
| 2011/0037230 | A1 | 2/2011 | O'Connor et al. |
| 2012/0205872 | A1 | 8/2012 | Reinhardt et al. |
| 2013/0269956 | A1 | 10/2013 | Yee |
| 2013/0292138 | A1 | 11/2013 | Givens et al. |

FORCE TRANSFERRING MEMBER FOR USE IN A TOOL

BACKGROUND

Field of the Disclosure

Embodiments of this disclosure generally relate to controlling the operation of a tool using a force transferring member.

Description of the Related Art

Controlling the operation of a tool that is located in a wellbore is problematic when different functions of the tool are actuated by different forces and/or pressure levels. For example, large volumes of fluid are pumped from the surface to pressurize the tool to obtain a predetermined pressure level, thereby actuating the tool to perform a specific function. When the tool is actuated, however, an impact force generated by the sudden release of the pressurized fluid can inadvertently cause the actuation of another function of the tool, unknowingly to an operator of the tool. The inadvertent actuation, e.g. the malfunction, of the tool causes confusion and potentially failure of the tool to perform subsequent functions.

One attempt to address inadvertent actuation of the tool includes spacing the forces and/or pressure levels that actuate the tool at large differences from each other. Another attempt includes using a choke or a dampening means to absorb the energy release of the pressurized fluid. Additional attempts include running smaller volume inner strings to minimize accumulation effects, or alternating hydraulic functions with mechanical/pneumatic/electrical initiated functions. These prior attempts each have many drawbacks.

Therefore, there is a continuous need for new and improved apparatus and methods for controlling the operation of wellbore tools.

SUMMARY

In one embodiment, a tool for use in a wellbore is disclosed herein. The tool includes a collet member, a cone member, a seal assembly, and a force transferring member. The seal assembly is coupled to the collet member and is in engagement with the core member. The force transferring member is movable from a first state to a second state. The first state prevents relative movement between the seal assembly and the cone member. In the second state, the seal assembly is movable relative to the cone member.

In another embodiment, a method of controlling a tool in a wellbore is disclosed herein. A force is transmitted from a collet member to a cone member, wherein a seal assembly coupled to the collet member engages the cone member. A force transferring member positioned in a first state prevents relative movement between the seal assembly and the cone member. The force transferring member is moved from the first state to a second state to allow movement between the seal assembly and the cone member. The seal assembly is moved relative to the cone member.

In one embodiment, a tool for use in a wellbore includes a cone member; a seal assembly in engagement with the cone member; and a force transferring member having a first state that prevents relative movement between the seal assembly and the cone member, and having a second state where the seal assembly is movable relative to the cone member.

In another embodiment, a method of controlling a tool in a wellbore includes coupling a seal assembly to a cone member using a force transferring member positioned in a first state; transmitting a force from the seal assembly to the cone member actuate a feature of the tool; changing the force transferring member from the first state to a second state to allow movement between the seal assembly and the cone member; and moving the seal assembly relative to the cone member.

BRIEF DESCRIPTION OF THE DRAWINGS

So that the manner in which the above recited features can be understood in detail, a more particular description of the embodiments briefly summarized above may be had by reference to the embodiments described below, some of which are illustrated in the appended drawings. It is to be noted, however, that the appended drawings illustrate only typical embodiments and are therefore not to be considered limiting of its scope, for the embodiments may admit to other equally effective embodiments.

For clarity, identical reference numerals have been used, where applicable, to designate identical elements that are common between figures. Additionally, elements of one embodiment may be advantageously adapted for utilization in other embodiments described herein.

DETAILED DESCRIPTION

Figure 1:
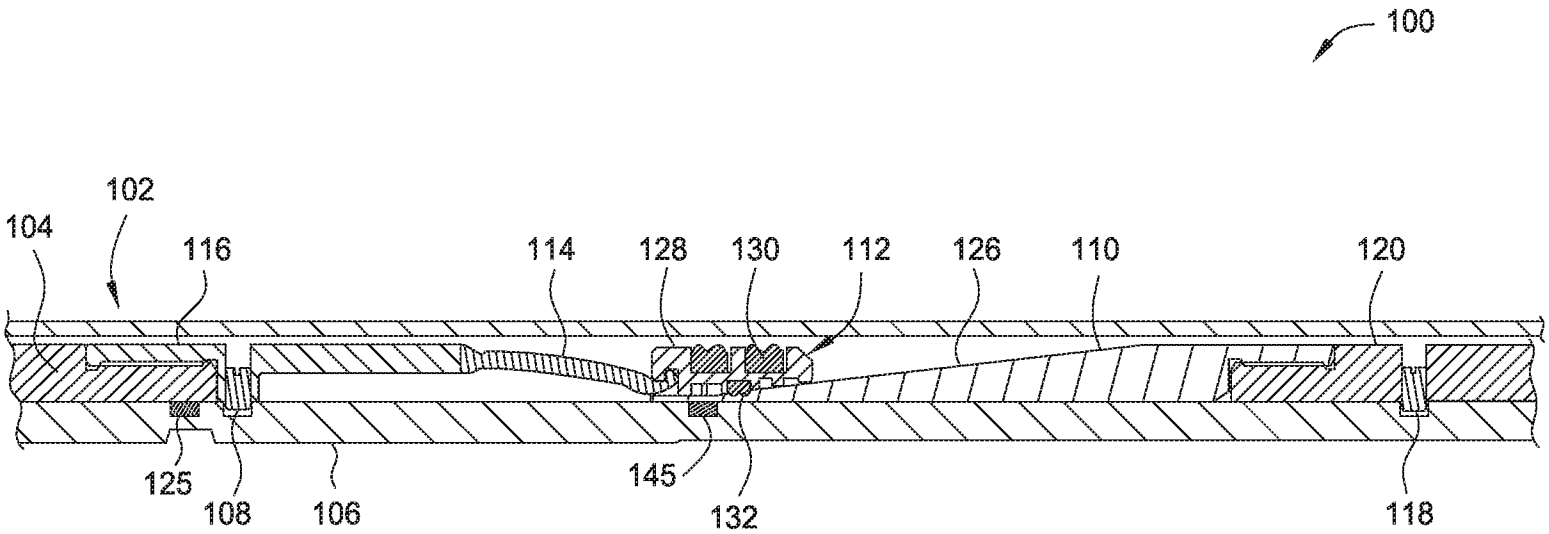
FIG. 1 illustrates a portion of a tool for use in a wellbore, according to one embodiment disclosed herein.

FIG. 1 illustrates a portion of a tool 100 for use in a wellbore that provides a seal within a casing 102, according to one embodiment disclosed herein. The tool 100 is actuated into different operational positions by applying one or more mechanical, hydraulic, pneumatic, and/or electrical forces to the tool 100. The tool 100 may be an anchor, a liner hanger, or any other type of tool used in wellbore operations.

The tool 100 includes an upper mandrel 104, an outer mandrel 116, a first releasable member 108, a collet member 114, a seal assembly 112, a cone member 110, a lower mandrel 120, a second releasable member 118, and an inner mandrel 106. The lower end of the upper mandrel 104 is coupled to the upper end of the outer mandrel 116, such as by a threaded connection. A seal 125 is disposed between the upper mandrel 104 and the inner mandrel 106. The outer mandrel 116 is releasably coupled to the inner mandrel 106 by the first releasable member 108. The outer mandrel 116 is also coupled to the upper end of the collet member 114. The lower end of the collet member 114 is coupled to the seal assembly 112, which engages a tapered surface 126 of the cone member 110. A seal 145 is disposed between the cone member 110 and the inner mandrel 106. The lower end of the cone member 110 is coupled to the upper end of the lower mandrel 120, which is coupled to the inner mandrel 106 by the second releasable member 118.

The seal assembly 112 is positioned at the base of the tapered surface 126 of the cone member 110. The seal assembly 112 includes a seal carrier 128, two outer seals 130, and an inner seal 132, which inner seal 132 sealingly contacts the tapered surface 126 of the cone member 110. The outer seals 130 and the inner seal 132 are supported by the seal carrier 128. The seal carrier 128 is moved up the tapered surface 126 so that the outer seals 130 seal against the casing 102 during operation of the tool 100, as further described herein.

Figure 2:
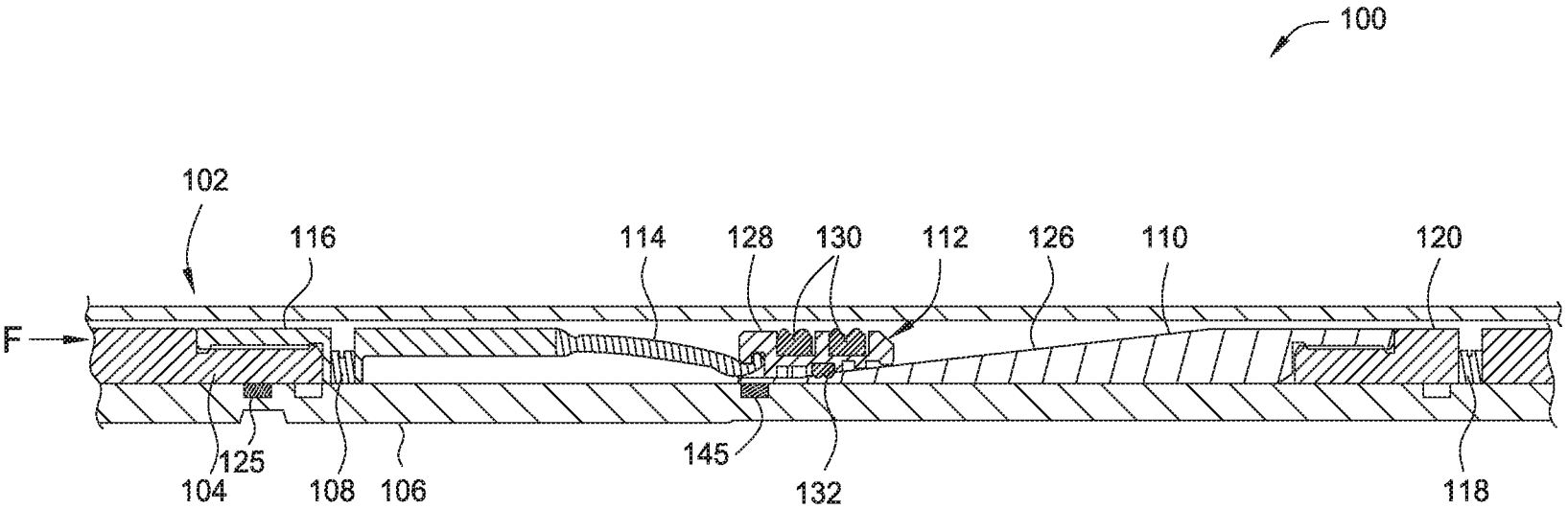
FIG. 2 illustrates the tool when actuated into a correct operational position, according to one embodiment disclosed herein.

FIG. 2 illustrates the tool 100 when correctly actuated into a first operational position, according to one embodiment disclosed herein. A force (identified by reference arrow "F") is applied to the upper mandrel 104. The origin of the force may be a mechanical, hydraulic, pneumatic, and/or electrical force applied to the tool 100. The force is transferred to the outer mandrel 116 to shear the first releasable member 108. When the first releasable member 108 is sheared, the force is transmitted to the collet member 114, the seal assembly 112, the cone member 110, and the lower mandrel 120 to shear the second releasable member 118. The amount of force required to shear the second releasable member 118 is less than the amount of force required to overcome friction between the seal assembly 112 and the tapered surface 126 of the cone member 110. When properly applied, the force is transmitted from the seal assembly 112 to the cone member 110 without moving the seal assembly 112 relative to the cone member 110 prior to shearing the second releasable member 118. Moving the seal assembly 112 up the tapered surface 126 of the cone member 110 before shearing the second releasable member 118 can pre-maturely wedge the seal assembly 112 between the casing 102 and the cone member 110 (as illustrated in FIG. 3).

The upper mandrel 104, the outer mandrel 116, the collet member 114, the seal assembly 112, the cone member 110, and the lower mandrel 120 are movable relative to the inner mandrel 106 when the second releasable member 118 is sheared. The force moves the upper mandrel 104, the outer mandrel 116, the collet member 114, the seal assembly 112, the cone member 110, and the lower mandrel 120 into a first operational position. The tool 100 may be actuated into the first operational position to perform a desired function, such as to actuate a slip assembly into engagement with the surrounding wellbore. The tool 100 may also be actuated into the first operational position to place the tool 100 in a desired condition for actuation into a second operational position. Subsequently, another force can be applied to the upper mandrel 104, the outer mandrel 116, and collet member 114 to move the seal assembly 112 up the tapered surface 126. The seal assembly 112 is then wedged between the casing 102 and the cone member 110 to form a seal.

Figure 3:
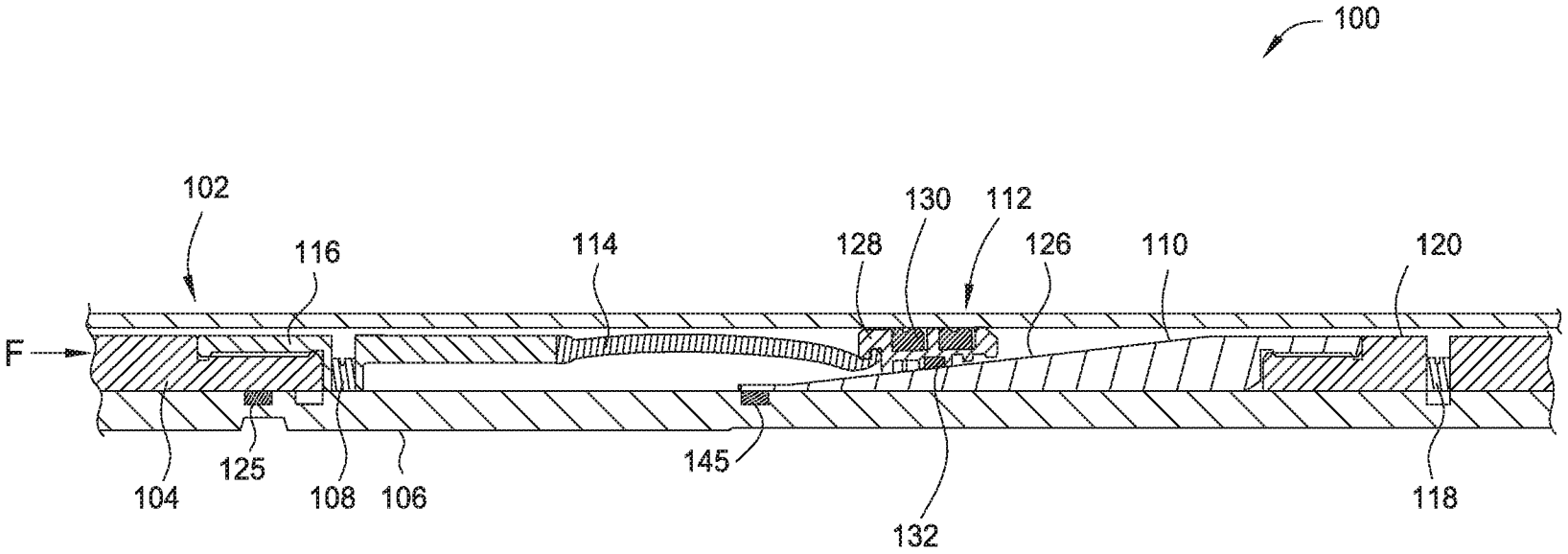
FIG. 3 illustrates the tool when inadvertently actuated into an incorrect operational position, according to one embodiment disclosed herein.

FIG. 3 illustrates the tool 100 when the seal assembly 112 is pre-maturely wedged between the casing 102 and the cone member 110 before the force is transmitted to shear the second releasable member 118. The failure to shear the second releasable member 118 may result in a malfunction of the tool 100. Any subsequent amount of force applied to the upper mandrel 104 in an attempt to shear the second releasable member 118 may be transmitted from the seal assembly 112 to the surrounding wellbore via the casing 102, possibly damaging the seal assembly 112, the casing 102, and/or the surrounding wellbore. A subsequent actuation of the tool 100 is prevented without conducting a remedial operation when the tool 100 is inadvertently actuated into the position shown in FIG. 3.

Figure 4:
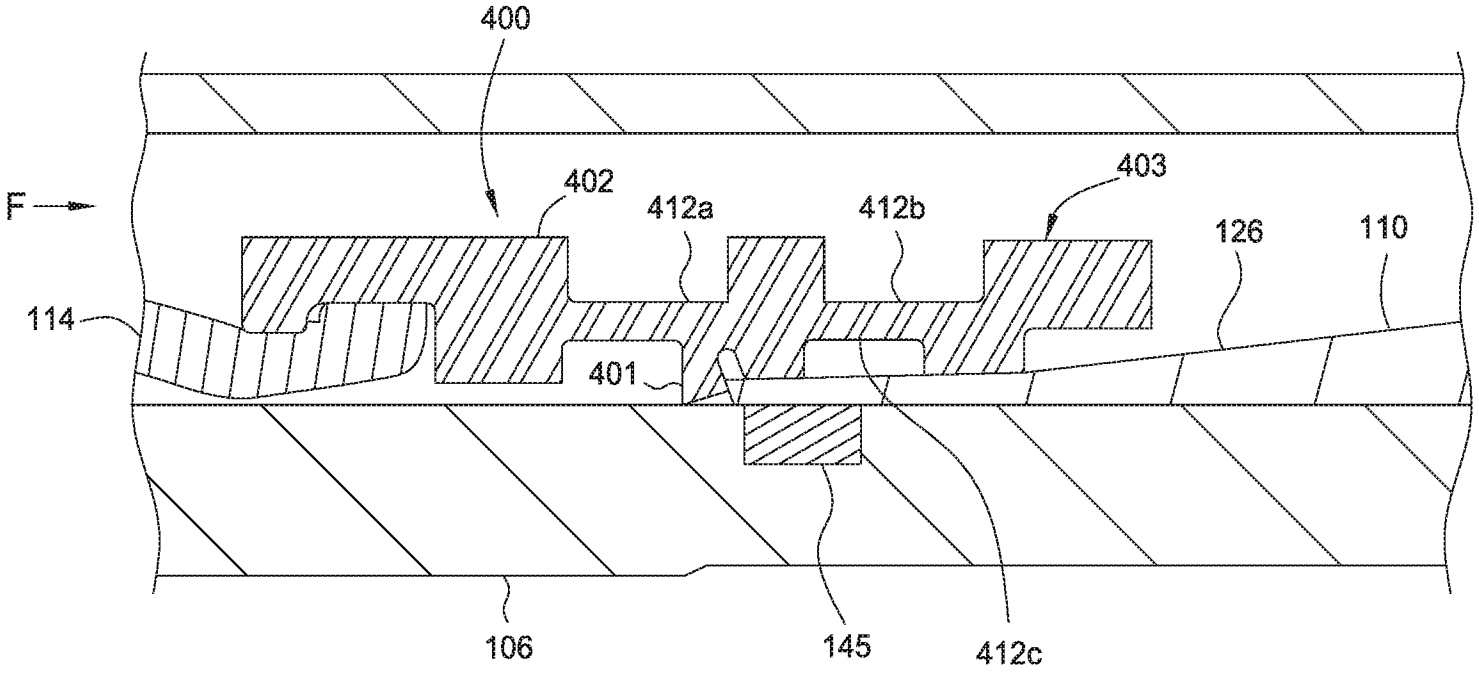
FIG. 4 illustrates an enlarged view of a force transferring member of the tool, according to one embodiment disclosed herein.

FIG. 4 illustrates an enlarged view of a modified portion of the tool 100 that is configured to prevent premature actuation of the seal assembly 112, according to one embodiment disclosed herein. The modified portion of the tool 100 includes a seal assembly 400 (with the seals removed for clarity) that has a force transferring member 401. The force transferring member 401 engages the upper end of the cone member 110. The force transferring member 401 forms a part of an annular body 402 of a seal carrier 403 of the seal assembly 400. Alternatively, the force transferring member 401 may be a separate piece that is coupled to the annular body 402. A plurality of grooves 412*a*, 412*b*, 412*c* is formed in the annular body 402 to support a plurality of outer seals 530 and inner seals 532 (as shown in FIGS. 5A-5C and 6) similar to the seal assembly 112 illustrated in FIG. 1.

In the embodiment shown in FIG. 4, the force transferring member 401 may be in the form of a deformable tab. As further described below with respect to FIG. 9, the force transferring member 401 may be in the form of a shearable pin. The force transferring member 401 may be formed integrally with the annular body 402, or may be separately coupled to the annular body 402. The force transferring member 401 is configured to transmit a force from the seal carrier 403 to the cone member 110. The force transferring member 401 aids in preventing relative movement between the seal assembly 400 and the cone member 110 when the force transferring member 401 is in a first state, as shown in FIG. 4. When the force acting on the force transferring member 401 exceeds a predetermined amount, the force transferring member 401 may deform to a second state, as shown in FIG. 5C and FIG. 6, to allow relative movement between the seal assembly 400 and the cone member 110 and allow the seal assembly 400 to be moved up the tapered surface 126 of the cone member 110 and seal against the surrounding casing, similarly as described with respect to FIG. 1 and as further described below with respect to FIGS. 5A-5C.

Figure 5A:
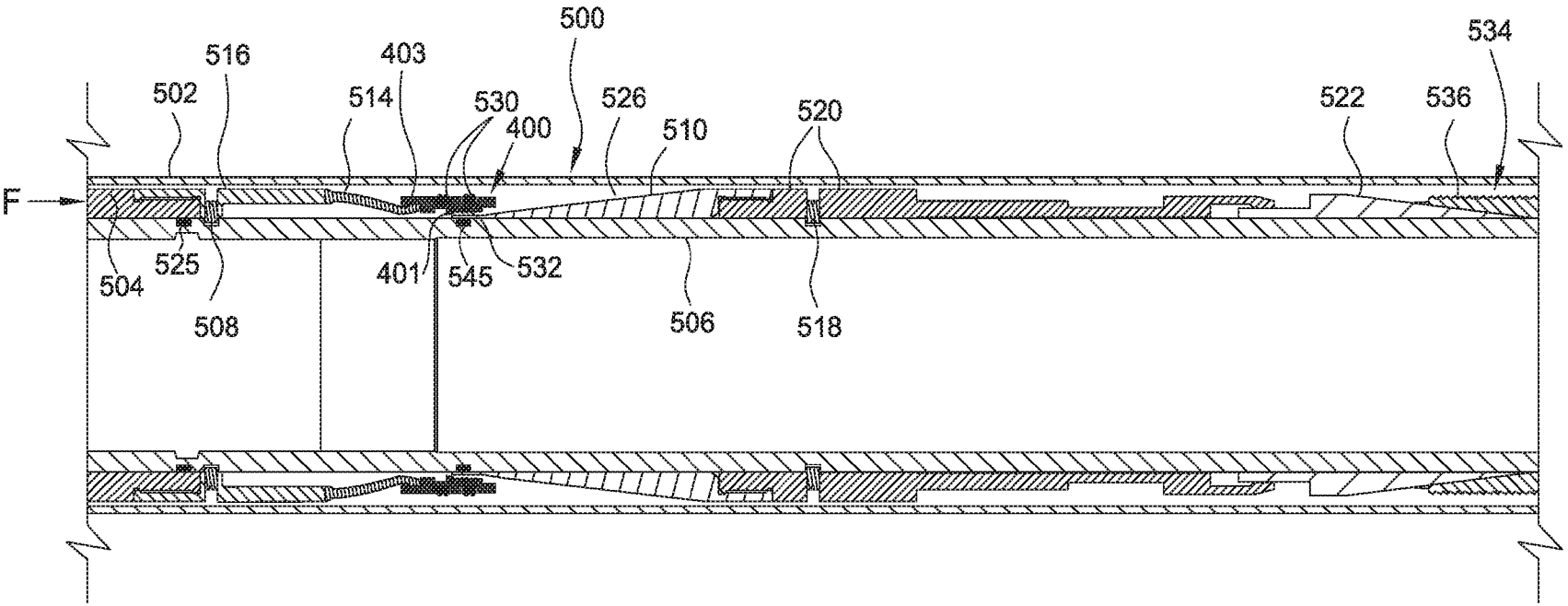
FIG. 5A, FIG. 5B, and FIG. 5C illustrate the tool in run-in, first set, and second set positions, according to one embodiment disclosed herein.
Figure 6:
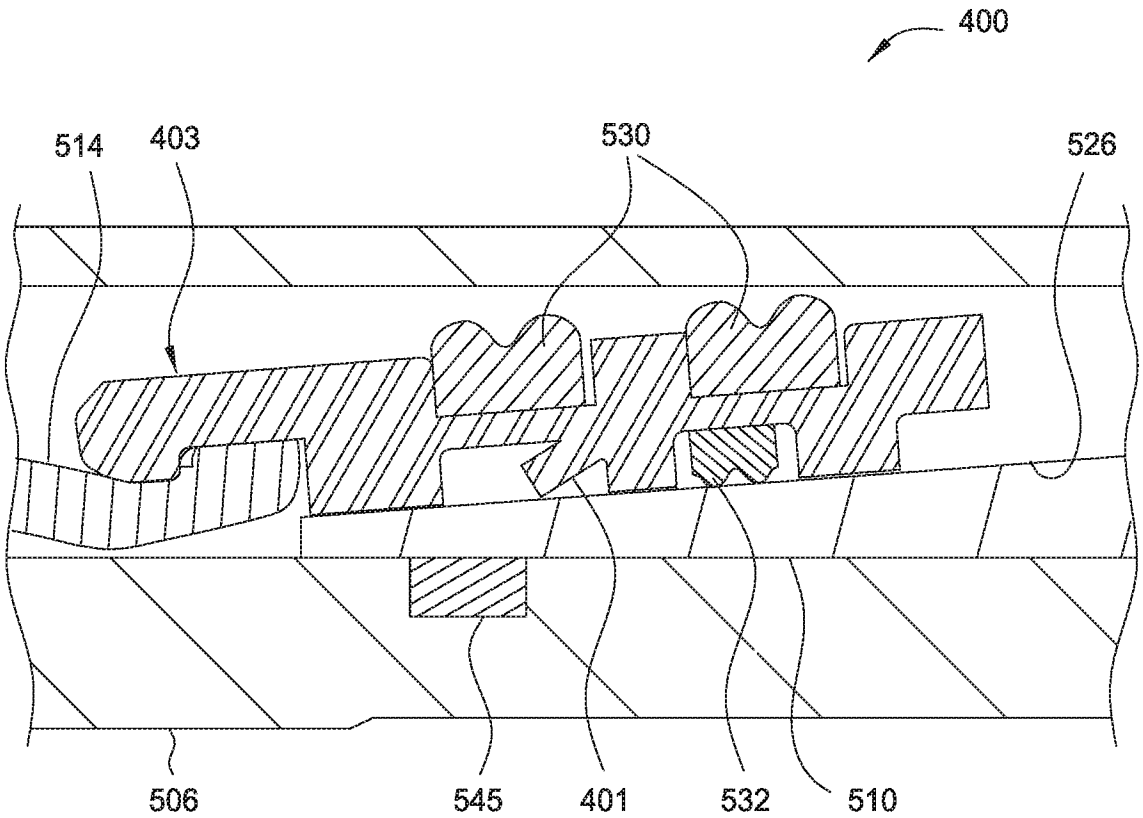
FIG. 6 illustrates an enlarged view of the force transferring member of the tool.

FIG. 5A illustrates a tool 500, in a run-in position, which is used to seal against a casing 502 at a desired location in a wellbore. The tool 500 is actuated into different operational positions by applying one or more mechanical, hydraulic, pneumatic, and/or electrical forces to the tool 500. The tool 500 may be an anchor, a liner hanger, or any other type of tool used in wellbore operations.

The tool 500 includes a slip assembly 534 having a wedge member 522 and an one or more slips 536. The tool 500 also includes an upper mandrel 504, an outer mandrel 516, a first releasable member 508, a collet member 514, the seal assembly 400, a cone member 510, a lower mandrel 520, a second releasable member 518, and an inner mandrel 506. The lower end of the upper mandrel 504 is coupled to the upper end of the outer mandrel 516. A seal 525 is disposed between the upper mandrel 504 and the inner mandrel 506. The outer mandrel 516 is releasably coupled to the inner mandrel 506 by the first releasable member 508. The outer mandrel 516 is also coupled to the collet member 514. The collet member 514 is coupled to the seal assembly 400, which engages a tapered surface 526 of the cone member 510. A seal 545 is disposed between the cone member 510 and the inner mandrel 506. The cone member 510 is coupled to the lower mandrel 520, which is releasably coupled to the inner mandrel 506 by the second releasable member 518.

The seal assembly 400 is positioned at the base of the tapered surface 526 of the cone member 510. The seal assembly 400 further includes two outer seals 530 and an inner seal 532, which are supported by the seal carrier 403. At the desired time, the seal carrier 403 is moved up the tapered surface 526 of the cone member 510 so that the outer seals 530 seal against the casing 502 during operation of the tool 500.

Figure 5B:
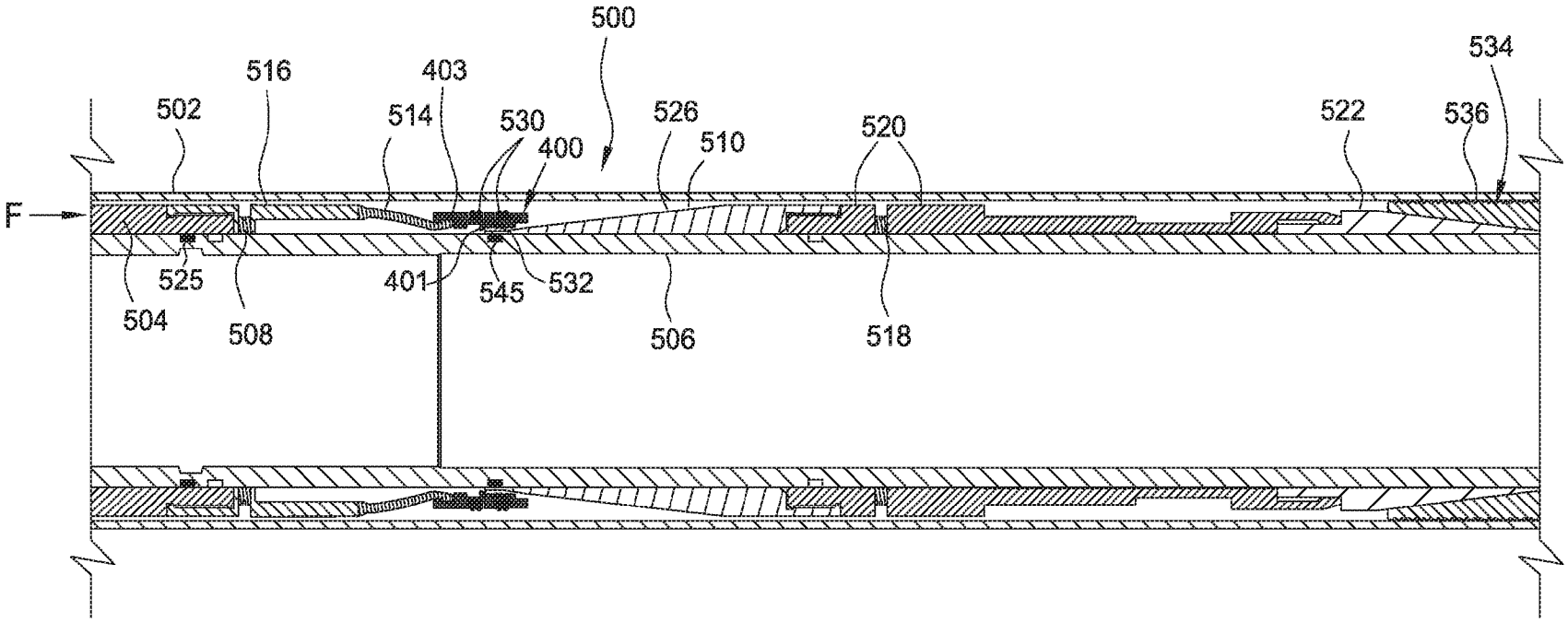
Figure 5C:
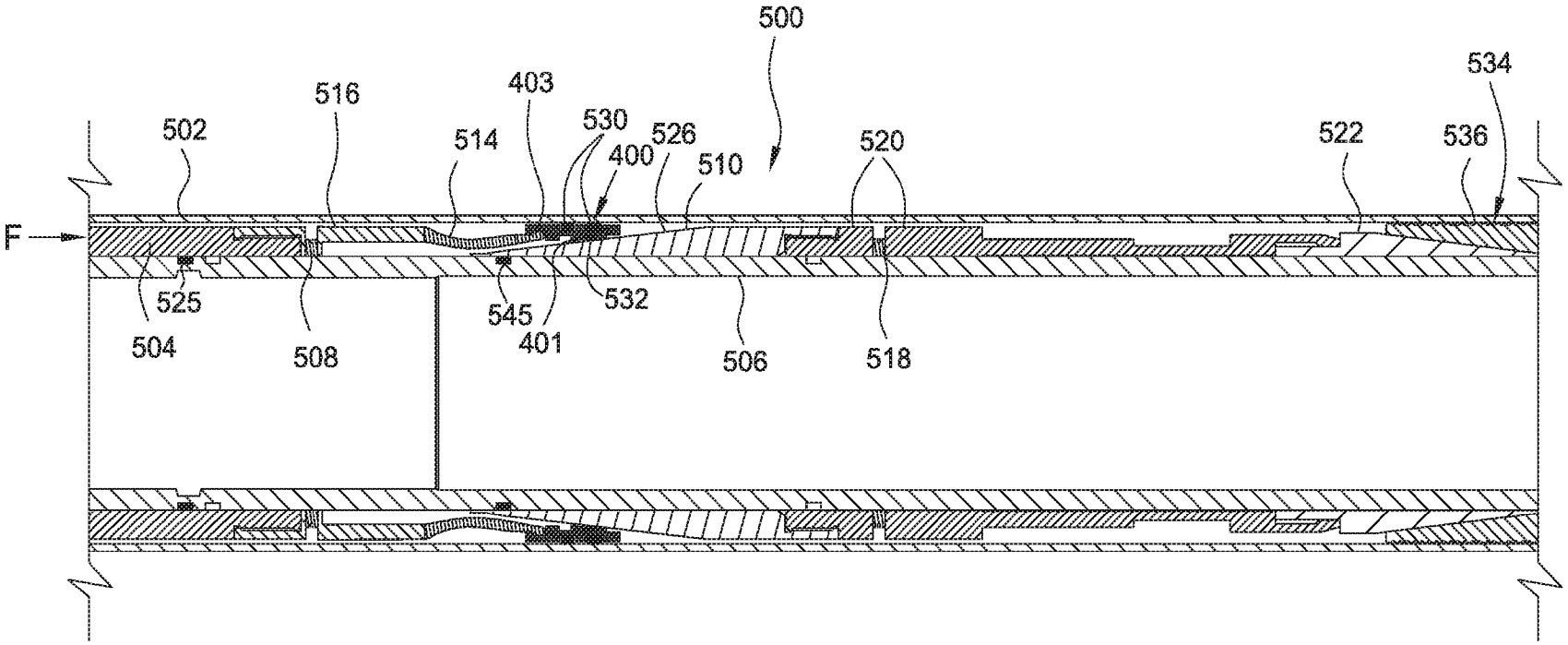

Referring to FIG. 5B, the tool 500 is actuated into a first set position by a force (identified by reference arrow "F") applied to the upper mandrel 504, which shears the first releasable member 508. The force applied to the tool 500 may be a mechanical, hydraulic, pneumatic, and/or electrical force. The force is transmitted from the upper mandrel 504 to the outer mandrel 516, the collet member 514, the seal carrier 403, and the force transferring member 401. The force transferring member 401 transfers the force to the cone member 510 and the lower mandrel 520, without forcing the seal assembly 400 up the tapered surface 526 of the cone member 510.

As more clearly illustrated in the enlarged view of FIG. 4, the force transferring member 401 is positioned adjacent to and engages the upper end of the cone member 510. The force transferring member 401 presses against the cone member 510 when the force applied to the upper mandrel 504 is transmitted to the seal carrier 403. The force transferring member 401 transfers the force provided to it from the upper mandrel 504 to the cone member 510 to prevent the seal assembly 400 from moving up the cone member 510 prior to shearing the second releasable member 518 and setting of the slips 536 as described below. The amount of force required to shear the second releasable member 518 is less than the amount of force required to deform the force transferring member 401 to prevent inadvertent movement of the seal assembly 400 relative to the cone member 510.

The upper mandrel 504, the outer mandrel 516, the collet member 514, the seal assembly 400, cone member 510, and lower mandrel 520 then move together relative to the inner mandrel 506 to shear the second releasable member 518. The force moves the upper mandrel 504, the outer mandrel 516, the collet member 514, the seal assembly 400, the cone member 510, and the lower mandrel 520 until the end surface of the lower mandrel 520 contacts the end surface of the wedge member 522. The wedge member 522 is then forced underneath the slips 536 to force the slips 536 radially outward into engagement with the casing 502. Wellbore fluids can be circulated back up to the surface around the slips 536 and the seal assembly 400 (which has not yet been set) to allow for displacement of a slurry. The slurry may be, for example, cement.

Referring to FIG. 5C, the tool 500 is actuated into a second set position. The same or a different force can be applied, or continue to be applied, to the upper mandrel 504. After the slips 536 are set, the upper mandrel 504, the outer mandrel 516, the collet member 514, the seal assembly 400, the cone member 510, and the lower mandrel 520 may be prevented from further movement relative to the inner mandrel 506. Continued application of the same or a different force to the upper mandrel 504 will then deform the force transferring member 401 from the first position to a second position (illustrated in FIG. 6) to allow the seal assembly 400 to move up the tapered surface 526 of the cone member 510 and radially outward into engagement with the casing 502 to form a seal.

FIG. 6 is an enlarged view of the seal assembly 400, the cone member 510, and the collet member 514 with the force transferring member 401 deformed or bent into the second position. In the second position, the force transferring member 401 forced over the upper end of the cone member 510 and thereby deformed or bent to allow the seal assembly 400 to move up the tapered surface 526 without any significant resistance from the force transferring member 401. The seal assembly 400 is movable radially outward into the engagement with the casing 502 when no additional barriers are present. Thus, a tight seal is formed between the seal assembly 400 and the casing 502.

Figure 7:
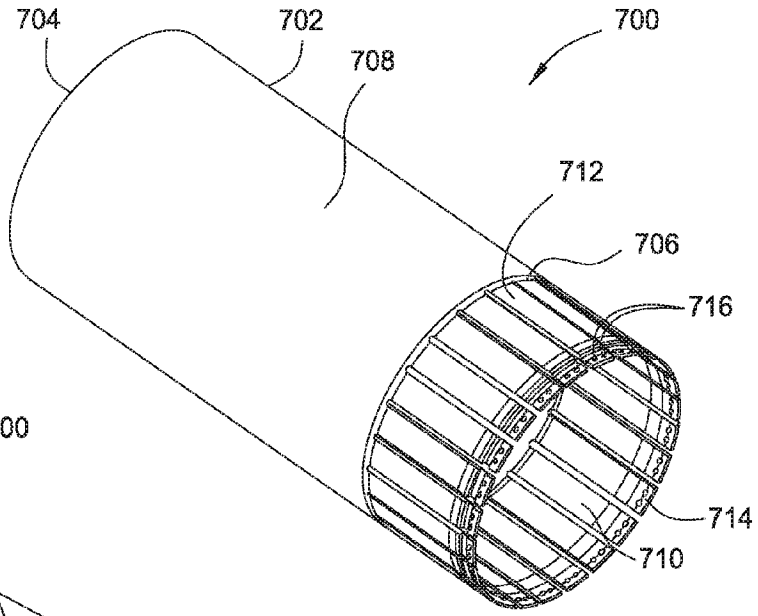
FIG. 7 illustrates a perspective view of a collet, according to one embodiment disclosed herein.

FIG. 7 illustrates an enlarged view of a collet member 700 for use with the tools 100, 500 according to one embodiment. The collet member 700 includes an annular body 702 having a first end 704 opposite a second end 706, an elongated surface 708, and a plurality of fingers 710. The elongated surface 708 connects the first end 704 to the second end 706. The plurality of fingers 710 includes a first end 712, a second end 714, and a plurality of holes 716. The first end 712 of each finger 710 is coupled to the second end 706 of the annular body 702. The second ends 714 are opposite the first ends 712 of each finger 710, and the plurality of holes 716 are formed in the second ends 714 of the fingers 710.

The collet member 700 may have, for example, 24 fingers 710 extending from the second end 706 of the annular body 702. Each finger 710 may have, for example, two holes 716, which allow for entry of a force transferring member (illustrated in FIG. 9), such as a shear pin. The force transferring member releasably connects the collet member 700 to a cone member as shown in FIG. 8.

Figure 8:
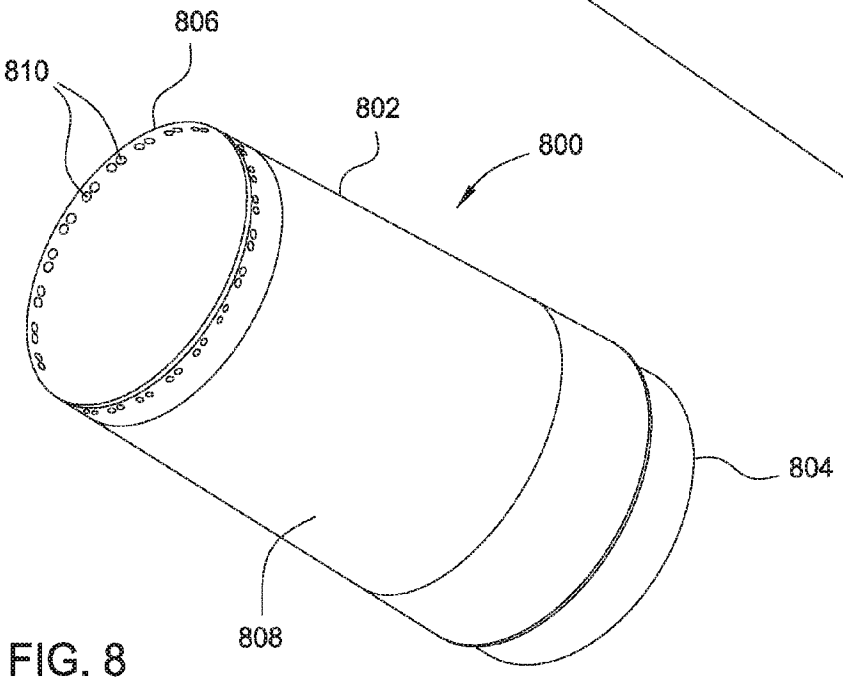
FIG. 8 illustrates a perspective view of a cone member, according to one embodiment disclosed herein.

FIG. 8 illustrates an enlarged view of a cone member 800 for use with the tools 100, 500 according to one embodiment. The cone member 800 includes an annular body 802 having a first end 804 opposite a second end 806, and an elongated surface 808 connecting the first end 804 to the second end 806. The second end 806 includes a plurality of holes 810, which surround the circumference of the annular body 802 at the second end 806. The plurality of holes 810 in the annular body 802 of the cone member 800 are configured to mate with the plurality of holes 716 in the collet member 700. A force transferring member (shown in FIG. 9), such as a shear pin, may be placed through the holes 810, 716 to temporarily connect the collet member 700 with the cone member 800.

Figure 9:
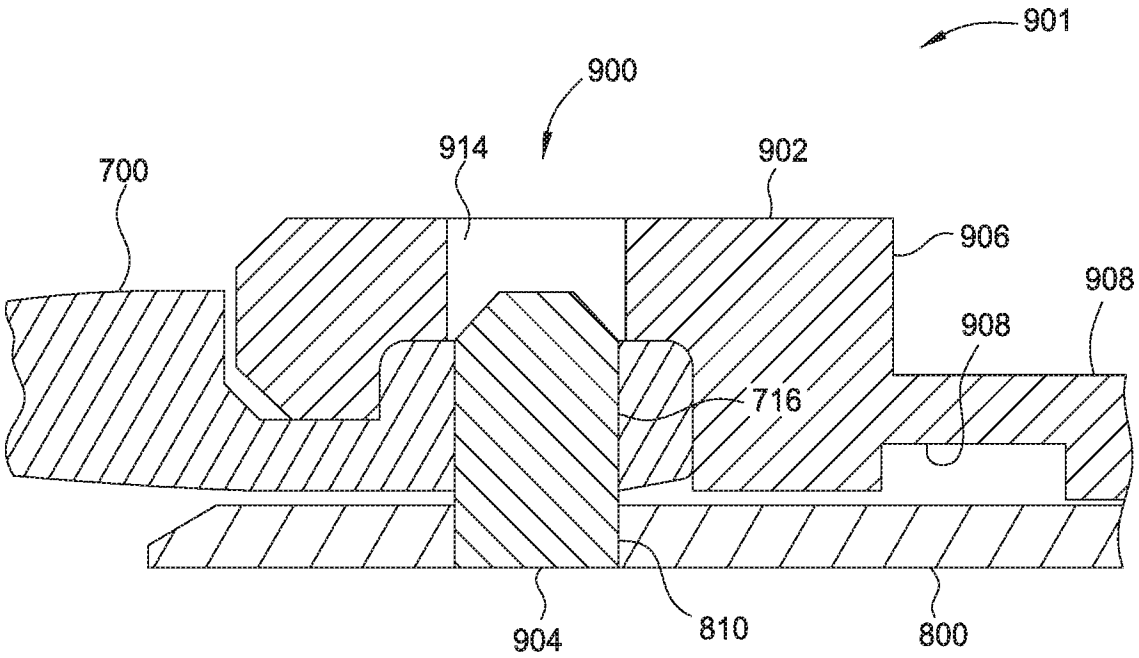
FIG. 9 illustrates an enlarged view of a portion of a tool in one position, according to one embodiment disclosed herein.

FIG. 9 illustrates an enlarged view of a portion of a tool 901, according to one embodiment. The tool 901 may be the same tool and/or operate the same as the tools 100, 500 described above. However, instead of the force transferring member 401 as illustrated in FIG. 4, the tool 901 includes a force transferring member 904 as illustrated in FIG. 9 and further described below. In one embodiment, the tools 100, 500, 901 may include a combination of the force transferring members 401, 904.

Referring to FIG. 9, the tool 901 includes the collet member 700, the cone member 800, a seal assembly 900, and the force transferring member 904. The seal assembly 900 includes a seal carrier 902 having an annular body 906 that is coupled to the collet member 700. The annular body 906 includes a plurality of grooves 908 configured to support one or more seals of the seal assembly 900, such as the seals 130 of the seal assembly 112 shown in FIG. 1.

The force transferring member 904 may be, for example, a shear pin, that is disposed in each of a plurality of holes 914 formed in the annular body 906 of the seal carrier 902. The plurality of holes 914 in the annular body 906 are configured to align with the plurality of holes 716 in each finger 710 of the collet member 700, as well as the plurality of holes 810 in the cone member 800. Each force transferring member 904 may be placed through the holes 914, 810, 716 to temporarily connect the cone member 800 and the collet member 700 with the seal assembly 900. In another embodiment, the force transferring member 904 is placed through the hole 914 of the annular body 906 and the hole 810 of the cone member. In another embodiment, the force transferring member 904 is placed through the hole 716 of the finger 710 and the hole 810 of the cone member 800.

Figure 10:
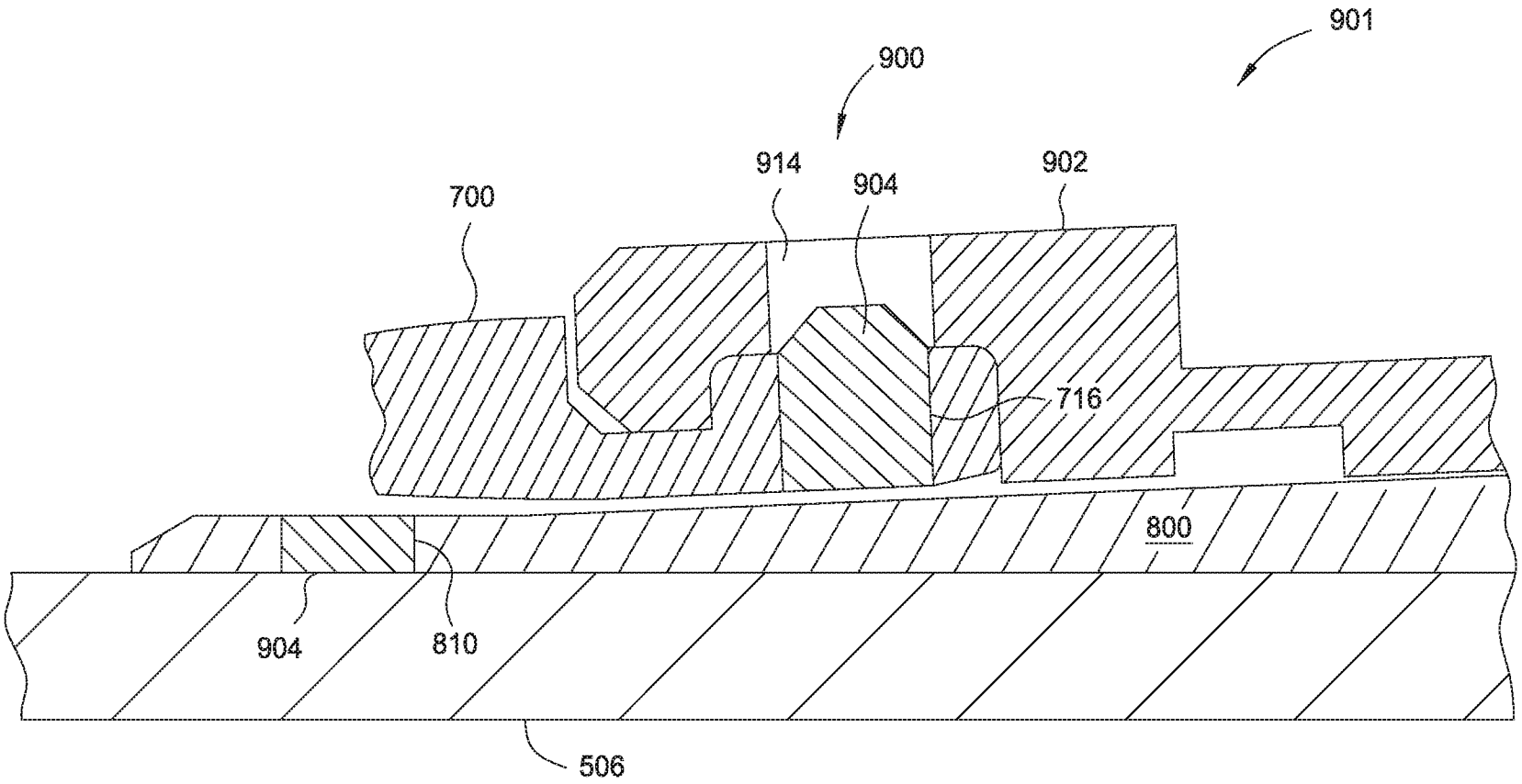
FIG. 10 illustrates an enlarged view of the portion of the tool illustrated in FIG. 9 in another position, according to one embodiment disclosed herein.

Each force transferring member 904 is configured to shear from a first state as shown in FIG. 9 to a second state as shown in FIG. 10 when it is desired for the seal assembly 900 to move up the tapered surface of the cone member 800. When in the first state, the force transferring member 904 aids in preventing relative movement between the seal assembly 900 and the cone member 800 to actuate the tool 901 into a first set position, such as the first set position of the tool 500 shown in FIG. 5B. In the first state, the force transferring member 904 transmits force from the collet member 700 to the cone member 800, while preventing inadvertent movement of the seal assembly 900 relative to the cone member 800.

As shown in FIG. 10, the force transferring member 904 has been sheared into the second state to allow relative movement between the collet member 700 (and thus the seal assembly 900) and the cone member 800, to allow the seal assembly 900 to move up the tapered surface of the cone member 800 and outward into the engagement with a surrounding casing to form a seal, similarly as described above with respect to tools 100, 500. As described above with respect to FIG. 5B, the cone member 800 may be prevented from further movement, such that a force applied or transmitted to the collet member 700 is directed to each force transferring member 904. When the pre-determined amount of force is applied, each force transferring member 904 will shear to allow the tool 901 to actuate into a sealing position, similarly as described above with respect to tools 100, 500.

In one embodiment, a tool for use in a wellbore includes a cone member; a seal assembly in engagement with the cone member; and a force transferring member having a first state that prevents relative movement between the seal assembly and the cone member, and having a second state where the seal assembly is movable relative to the cone member.

In one or more of the embodiments described herein, the force transferring member is a deformable tab.

In one or more of the embodiments described herein, the force transferring member is a shearable pin.

In one or more of the embodiments described herein, the force transferring member in the first state engages an upper end of the cone member to prevent relative movement between the seal assembly and the cone member.

In one or more of the embodiments described herein, the force transferring member in the second state is deformed or sheared to allow relative movement between the seal assembly and the cone member.

In one or more of the embodiments described herein, the seal assembly includes a seal carrier and one or more seals coupled to the seal carrier, and wherein the force transferring member is coupled to a body of the seal carrier.

In one or more of the embodiments described herein, a plurality of outer seals are coupled to the seal carrier and configured to seal against a surrounding wellbore, and wherein a plurality of inner seals are coupled to the seal carrier and configured to seal against the cone member.

In one or more of the embodiments described herein, the seal assembly includes a seal carrier and one or more seals coupled to the seal carrier, and wherein the force transferring member is formed integrally with a body of the seal carrier.

In one or more of the embodiments described herein, the force transferring member includes a shearable pin disposed in one or more holes formed through the seal assembly and the cone member.

In one or more of the embodiments described herein, a collet member is coupled to the seal assembly.

In one or more of the embodiments described herein, the force transferring member includes a shearable pin disposed in one or more holes formed through the collet member and the cone member.

In another embodiment, a method of controlling a tool in a wellbore includes transmitting a force from a collet member to a cone member, wherein a seal assembly coupled to the collet member engages the cone member; preventing relative movement between the seal assembly and the cone member using a force transferring member positioned in a first state; changing the force transferring member from the first state to a second state to allow movement between the seal assembly and the cone member; and moving the seal assembly relative to the cone member.

In another embodiment, a method of controlling a tool in a wellbore includes coupling a seal assembly to a cone member using a force transferring member positioned in a first state; transmitting a force from the seal assembly to the cone member actuate a feature of the tool; changing the force transferring member from the first state to a second state to allow movement between the seal assembly and the cone member; and moving the seal assembly relative to the cone member.

In one or more of the embodiments described herein, changing the force transferring member from the first state to the second state includes deforming the force transferring member.

In one or more of the embodiments described herein, changing the force transferring member from the first state to the second state includes shearing the force transferring member.

In one or more of the embodiments described herein, the method includes transmitting the force from the collet member to the cone member to set one or more slips of the tool prior to moving the seal assembly relative to the cone member.

In one or more of the embodiments described herein, changing the force transferring member from the first state to the second state includes transmitting another force from the collet member to the force transferring member to deform or shear the force transferring member.

In one or more of the embodiments described herein, the force transferring member in the first state engages an upper end of the cone member to prevent relative movement between the seal assembly and the cone member.

In one or more of the embodiments described herein, moving the seal assembly relative to the cone member comprises moving the seal assembly up a tapered surface of the cone member.

In one or more of the embodiments described herein, the method includes moving the seal assembly into engagement with a surrounding wellbore to form a seal between the surrounding wellbore and the cone member.

In one or more of the embodiments described herein, the force transferring member comprises a deformable tab that is coupled to or integral with a body of the seal assembly.

In one or more of the embodiments described herein, the force transferring member comprises a shearable pin disposed through one or more holes formed through at least one of the collet member and the cone member.

In one or more of the embodiments described herein, transmitting the force from the seal assembly to the cone member sets one or more slips of the tool prior to moving the seal assembly relative to the cone member.

In one or more of the embodiments described herein, changing the force transferring member from the first state to the second state comprises transmitting another force from the seal assembly to the force transferring member to deform or shear the force transferring member.

While the foregoing is directed to one or more embodiments, other and further embodiments may be devised without departing from the basic scope thereof, and the scope thereof is determined by the claims that follow.

The invention claimed is:

1. A tool for use in a wellbore, the tool comprising: a cone member; a seal assembly in engagement with the cone member; and a force transferring member having a first state that prevents relative movement between the seal assembly and the cone member, and having a second state where the seal assembly is movable relative to the cone member, wherein the force transferring member in the first state engages an upper most end surface of the cone member to prevent relative movement between the seal assembly and the cone member.

2. The tool of claim 1, wherein the force transferring member in the second state is deformed to allow relative movement between the seal assembly and the cone member.

3. The tool of claim 1, wherein the seal assembly includes a seal carrier and one or more seals coupled to the seal carrier, and wherein the force transferring member is coupled to a body of the seal carrier.

4. The tool of claim 3, wherein a plurality of outer seals are coupled to the seal carrier and configured to seal against a surrounding wellbore, and wherein a plurality of inner seals are coupled to the seal carrier and configured to seal against the cone member.

5. The tool of claim 1, wherein the seal assembly includes a seal carrier and one or more seals coupled to the seal carrier, and wherein the force transferring member is formed integrally with a body of the seal carrier.

6. The tool of claim 1, further comprising a collet member coupled to the seal assembly.

7. The tool of claim 1, wherein the force transferring member is a deformable tab.

8. The tool of claim 1, wherein the force transferring member, in the first state, extends below a tapered surface of the cone member.

9. The tool of claim 8, wherein the force transferring member, in the second state, moves along the tapered surface.

10. A method of controlling a tool in a wellbore, the method comprising:

transmitting a force from a collet member to a cone member, wherein a seal assembly coupled to the collet member engages the cone member;

preventing relative movement between the seal assembly and the cone member by engaging a force transferring member positioned in a first state against an end of the cone member;

changing the force transferring member from the first state to a second state to allow movement between the seal assembly and the cone member; and moving the seal assembly relative to the cone member.

11. The method of claim 10, wherein changing the force transferring member from the first state to the second state comprises deforming the force transferring member.

12. The method of claim 10, wherein the force transferring member comprises a deformable tab that is coupled to or integral with a body of the seal assembly.

13. The method of claim 10, wherein the force transferring member in the first state engages an upper end of the cone member to prevent relative movement between the seal assembly and the cone member.

14. The method of claim of claim 10, wherein moving the seal assembly relative to the cone member comprises moving the seal assembly up a tapered surface of the cone member.

15. The method of claim of claim 10, further comprising moving the seal assembly into engagement with a surrounding wellbore to form a seal between the surrounding wellbore and the cone member.

16. The method of claim 10, further comprising transmitting the force from the collet member to the cone member to set one or more slips of the tool prior to moving the seal assembly relative to the cone member.

17. The method of claim 10, wherein changing the force transferring member from the first state to the second state comprises transmitting another force from the collet member to the force transferring member to deform the force transferring member.

18. A tool for use in a wellbore, the tool comprising:

a cone member;

a seal assembly in engagement with the cone member;

a collet member coupled to the seal assembly; and a force transferring member having a first state that prevents relative movement between the seal assembly and the cone member, and having a second state where the seal assembly is movable relative to the cone member, wherein the force transferring member includes a shearable pin disposed in one or more holes formed through the cone member and at least one of the collet member and the seal assembly.

* * * * *